US006735816B2

(12) United States Patent
Oh et al.

(10) Patent No.: US 6,735,816 B2
(45) Date of Patent: May 18, 2004

(54) UPRIGHT-TYPE VACUUM CLEANER

(75) Inventors: Jang-Keun Oh, Gwangju (KR); Min-jo Choi, Gwangju (KR)

(73) Assignee: Samsung Gwangju Electronics Co., Ltd., Gwangju (KR)

( * ) Notice: Subject to any disclaimer, the term of this patent is extended or adjusted under 35 U.S.C. 154(b) by 312 days.

(21) Appl. No.: 10/074,161

(22) Filed: Feb. 12, 2002

(65) Prior Publication Data

US 2002/0178535 A1 Dec. 5, 2002

(30) Foreign Application Priority Data

Jun. 4, 2001 (JP) ..... 2001-31233

(51) Int. Cl.[7] ..... A47L 9/16

(52) U.S. Cl. ..... 15/353; 15/352; 55/429; 55/DIG. 3

(58) Field of Search ..... 15/347, 350–353; 55/337, 429, 459.1, 482, 486, DIG. 3

(56) References Cited

U.S. PATENT DOCUMENTS 5,145,499 A * 9/1992 Dyson ..... 55/337
6,192,550 B1 * 2/2001 Hamada et al. ..... 15/352
6,482,252 B1 * 11/2002 Conrad et al. ..... 96/57
6,579,334 B2 6/2003 Oh et al.
6,589,309 B2 7/2003 Oh et al.

FOREIGN PATENT DOCUMENTS

| | | |
|---|---|---|
| EP | 0928594 | 7/1999 |
| GB | 2321181 | 7/1998 |
| GB | 2359984 | 9/2001 |
| GB | 2361863 | 11/2001 |
| GB | 2370978 | 7/2002 |
| GB | 2370979 | 7/2002 |
| GB | 2373174 | 9/2002 |

* cited by examiner

*Primary Examiner*—Terrence R. Till
(74) *Attorney, Agent, or Firm*—Ladas & Parry

(57) ABSTRACT

An upright-type vacuum cleaner in which a cyclone body is connected to and separated from a cleaner body without the use of a separate tool. The upright-type vacuum cleaner has a cleaner body having a suction brush formed at a lower part, and a vacuum-generating device built therein. A cyclone unit for separating dust from the air drawn through a suction passage is connected with the suction brush, and discharges the cleaned air through a discharging passage connected with the vacuum-generating device. A dust-container is removably connected with a lower part of the cyclone unit, for collecting the separated dust by the cyclone unit. The cyclone unit has a locking handle, and a handle connection portion for removably connecting with the locking handle, formed on a corresponding place on the cleaner body.

8 Claims, 7 Drawing Sheets

UPRIGHT-TYPE VACUUM CLEANER

BACKGROUND OF THE INVENTION

1. Field of the Invention

The present invention relates generally to an upright-type vacuum cleaner, and more particularly to an upright-type vacuum cleaner having a cyclone unit, which separates dust from an air current by a centrifugal force as drawn air forms a whirling air current.

2. Description of the Related Art

In an upright-type vacuum cleaner having a cyclone unit, a cyclone body for separating dust from a dust-laden air by a centrifugal force is generally formed in a dust-collecting chamber of a cleaner body. In addition, a dust-container for collecting the dust separated in the cyclone body by the centrifugal force is formed at a lower part of the cyclone body in the dust-collecting chamber.

However, a conventional upright-type vacuum cleaner with the above construction has some problems, which are enumerated below.

First, in the conventional upright-type vacuum cleaner, the cyclone body is connected with the cleaner body by a screw. Therefore, cleaning, repair, and maintenance of the vacuum cleaner is not easily done, and in some cases, the life span of the vacuum cleaner is shortened.

In other words, to connect the cyclone body with the cleaner body or to separate the cyclone body from the cleaner body, not only is a separate tool needed, such as a screwdriver, but also a long time is spent to fasten or unfasten a screw.

In addition, to clean or repair the cyclone body, a user necessarily unscrews and screws the screw. As the number of cycles of unscrewing and screwing is increased, there is a possibility of damaging the screw connection part of the cleaner body, thereby preventing the user from using the vacuum cleaner.

Second, in the conventional upright-type vacuum cleaner, a sloping groove is formed at a lower side of the dust-container, and a lever-type connection/separation means, which has a protrusion for elevating and lowering the dust-container by moving along the sloping groove, is disposed at a lower part of the dust-container. If the connection/separation means is rotated to the right or the left, the protrusion moves along the sloping groove, thereby connecting with or separating the cyclone body from the cleaner body as the dust-container is elevated or lowered. To connect the dust-container with the cleaner body, or to separate the dust-container from the cleaner body, the user necessarily connects or separates the dust-container with or from the cyclone body, thus friction between the lower side of the dust-container and the connection/separation means is accompanied.

Moreover, the dust-container should be separated at any time from the cleaner body for removing collected dust. Therefore, if the vacuum cleaner is used for a long time, the sloping groove of the dust-container becomes scratched by the friction.

Although the scratches do not affect functioning of the vacuum cleaner, considering that the dust-container is usually formed by injection molding with transparent material, it can damage the beauty and aesthetics of the vacuum cleaner.

SUMMARY OF THE INVENTION

Accordingly, a first object of the present invention is to solve the first problem of the conventional upright-type vacuum cleaner and thus to provide an upright-type vacuum cleaner in which the cyclone body is connected to and separated from the cleaner body easily and quickly without using a separate tool such as a screwdriver.

A second object of the present invention is to solve the second problem of the conventional upright-type vacuum cleaner and thus to provide an upright-type vacuum cleaner in which the dust-container is connected and separated with or from the cleaner body without causing any aesthetic damage to the dust container or cleaner body due to frictional wear between the two.

The first object of the present invention is accomplished by providing an upright-type vacuum cleaner comprising a cleaner body in which a suction brush is formed at a lower part, a vacuum-generating device being built therein, a cyclone unit for separating dust from the air drawn through a suction passage connected with the suction brush, discharging the cleaned air through a discharging passage connected with the vacuum-generating device, and a dust-container, removably connected with a lower part of the cyclone unit for collecting the dust separated by the cyclone unit, the cyclone unit having a locking handle, and a handle connection portion, the locking handle being removably connected by the handle connection portion to the cleaner body. In the preferred embodiment of the present invention, the locking handle comprises a rotating knob.

Moreover, the second object of the present invention is accomplished by providing an upright-type vacuum cleaner comprising a cleaner body in which a suction brush is formed at a lower part, a vacuum-generating device being built therein, a cyclone unit for separating dust from the air drawn through a suction passage connected with the suction brush, discharging the cleaned air through a discharging passage connected with the vacuum-generating device, and a dust-container, removably connected with a lower part of the cyclone unit for collecting the dust separated by the cyclone unit. The dust-container is removably connected to the cyclone unit by a locking unit that moves upwardly and downwardly.

In the preferred embodiment of the present invention, the locking unit includes an operating lever rotatably installed on the cleaner body. A locking disk moves upwardly and downwardly by rotating the operating lever. The operating lever and the locking disk each have cam units which effectuate the upward and downward motion of the locking unit when the operating lever is rotated.

BRIEF DESCRIPTION OF THE DRAWINGS

The above mentioned objects and features of the present invention will be more apparent by describing the preferred embodiment of the present invention in detail by referring to the appended drawings, in which.

DETAILED DESCRIPTION OF THE PREFERRED EMBODIMENT

Figure 1:
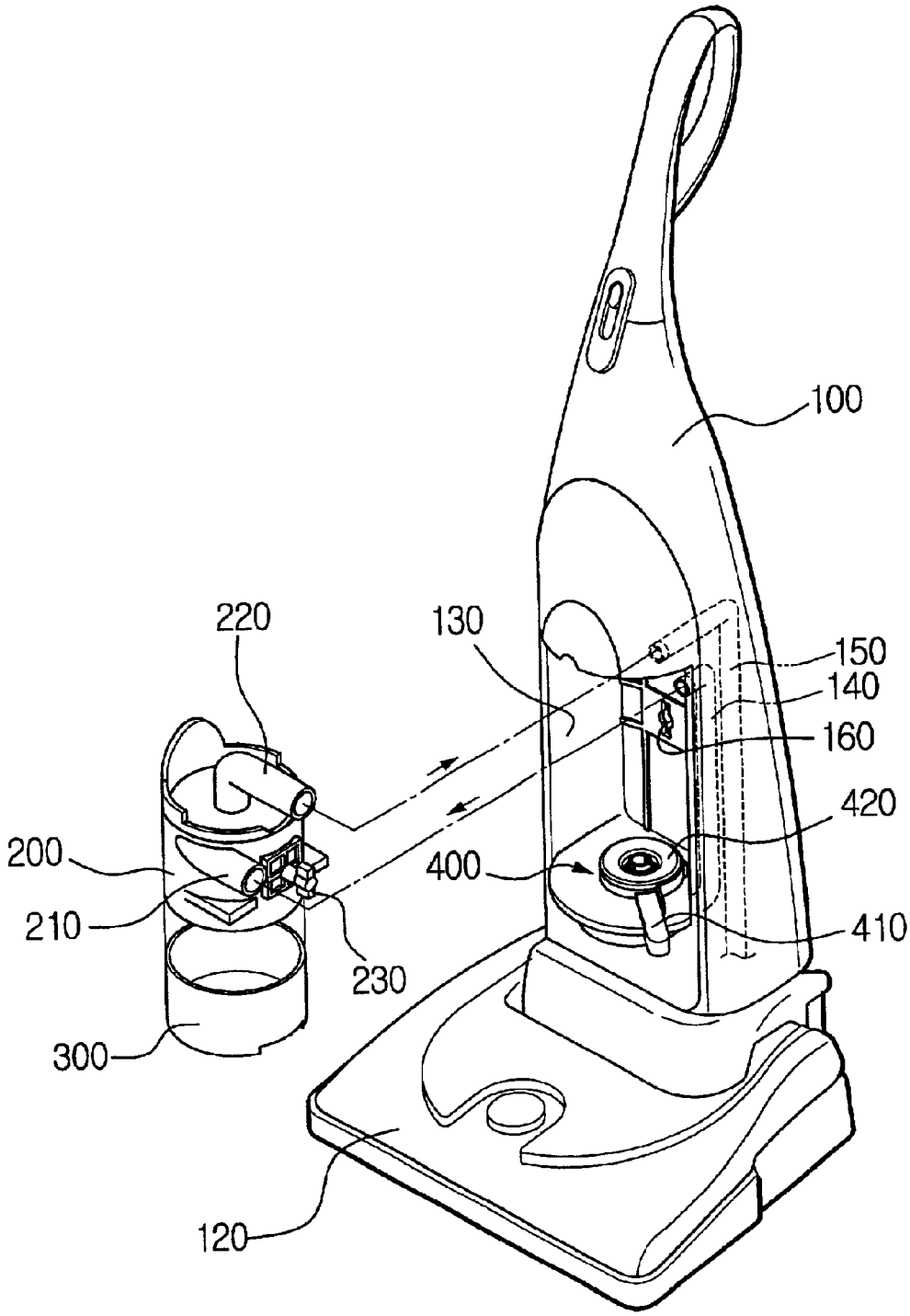
FIG. 1 is a partially exploded, perspective view showing an upright-type vacuum cleaner according to the present invention.
Figure 2:
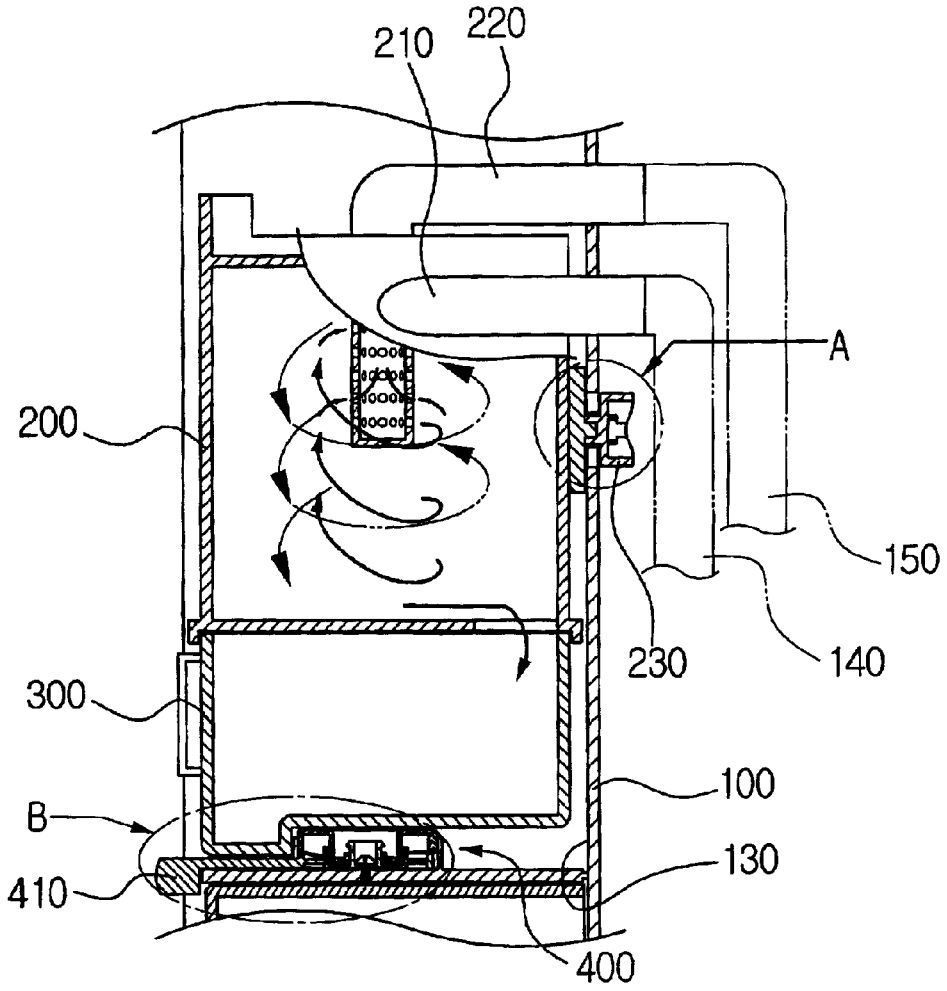
FIG. 2 is a sectional view showing a cyclone body and a dust-container mounted on the cleaner body of the upright-type vacuum cleaner according to the present invention.

FIGS. 1 and 2 illustrate one embodiment of an upright-type vacuum cleaner according to the present invention. The upright-type vacuum cleaner of the present invention includes a cleaner body 100, a cyclone unit 200, a dust-container 300, and a locking unit 400.

A vacuum-generating device (not shown) is disposed in the cleaner body 100. In addition, a suction brush 120 is disposed at a lower part of the cleaner body 100. A cyclone-embracing portion 130 is disposed at a front center of the cleaner body 100.

A suction passage 210 connected with the suction brush 120 is disposed at an upper part of the cyclone unit 200. Dust drawn through the suction brush 120 is drawn into the cyclone unit 200 through the suction passage 210. The suction passage 210 is disposed so that the drawn air passed therethrough is drawn in a tangential direction with respect to the cyclone unit 200. Therefore, the air drawn through the suction passage 210 forms a whirling air current along the inside wall of the cyclone unit 200.

A discharging passage 220, connected with the vacuum-generating device, is disposed at the upper center of the cyclone unit 200. The cleaned air in the cyclone body 200 is discharged outside of the cleaner body 100 through the vacuum-generating device and the discharging passage 220.

One end of a pair of tubes 140 and 150, which each of their other ends are connected with the vacuum-generating device and the suction brush 120, are disposed in an interior wall of the cyclone embracing portion 130. The tubes 140 and 150 are disposed so that one end of each of the tubes face the front.

To correspond to the tubes 140 and 150, the suction passage 210 and the discharging passage 220 of the cyclone unit 200 are disposed facing rearward and in parallel with each other so that the suction passage 210 and the discharging passage 220 can be easily connected with the tubes 140 and 150, by a horizontal movement of the cyclone unit 200.

Figure 3:
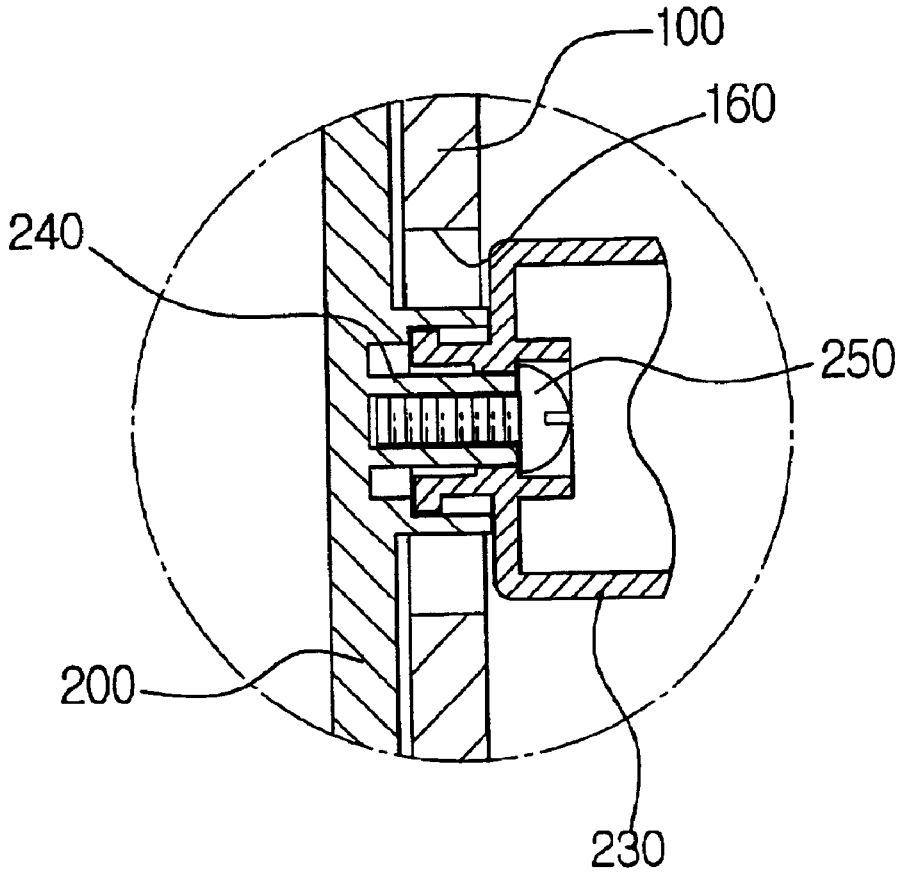
FIG. 3 is a detail view showing an enlarged part "A" of FIG. 2.

A locking handle 230 is disposed at the rear of the cyclone unit 200. As shown in FIG. 3, a hinge shaft 240 protrudes from an outer side of the cyclone unit 200, and the locking handle 230 is rotatably connected with the hinge shaft 240 by a screw 250.

Figure 4:
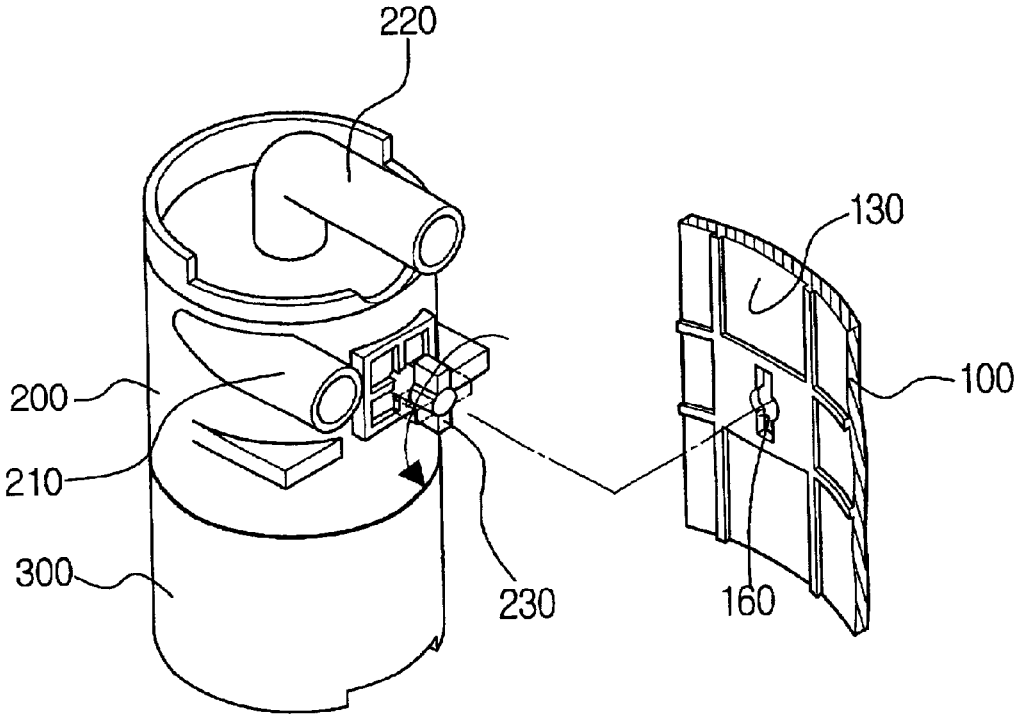
FIG. 4 is an exploded, perspective view showing the connection of the locking handle and the handle connection portion of the upright-type vacuum cleaner according to the present invention.

As also shown in FIG. 4, a handle connection portion 160 is formed at a corresponding place to the cleaner body 100, so that if the locking handle 230 is passed through the handle connection portion 160 and rotated 90°, then the cyclone unit 200 is firmly mounted on the cleaner body 100.

Figure 5:
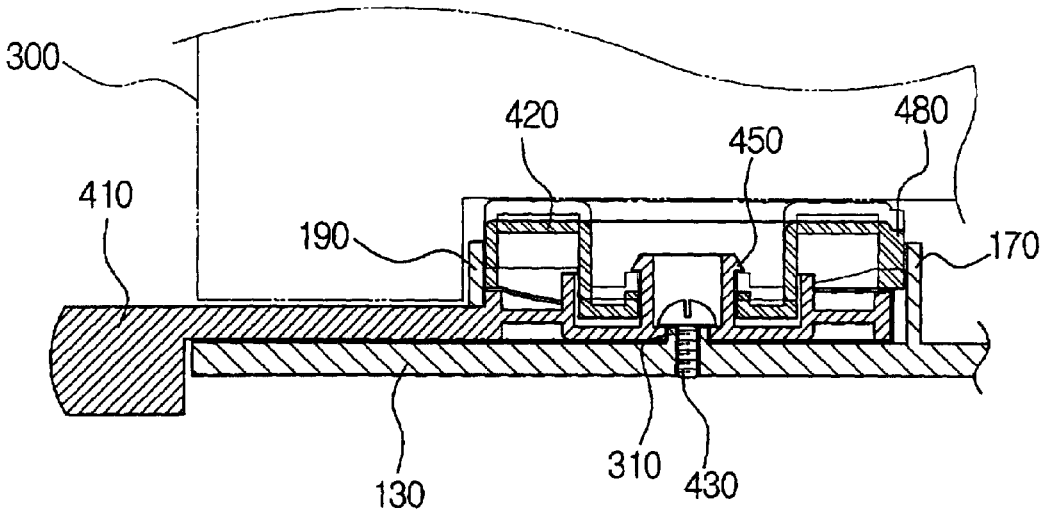
FIG. 5 is a cross-sectional view showing in detail an enlarged part "B" of FIG. 2.
Figure 6:
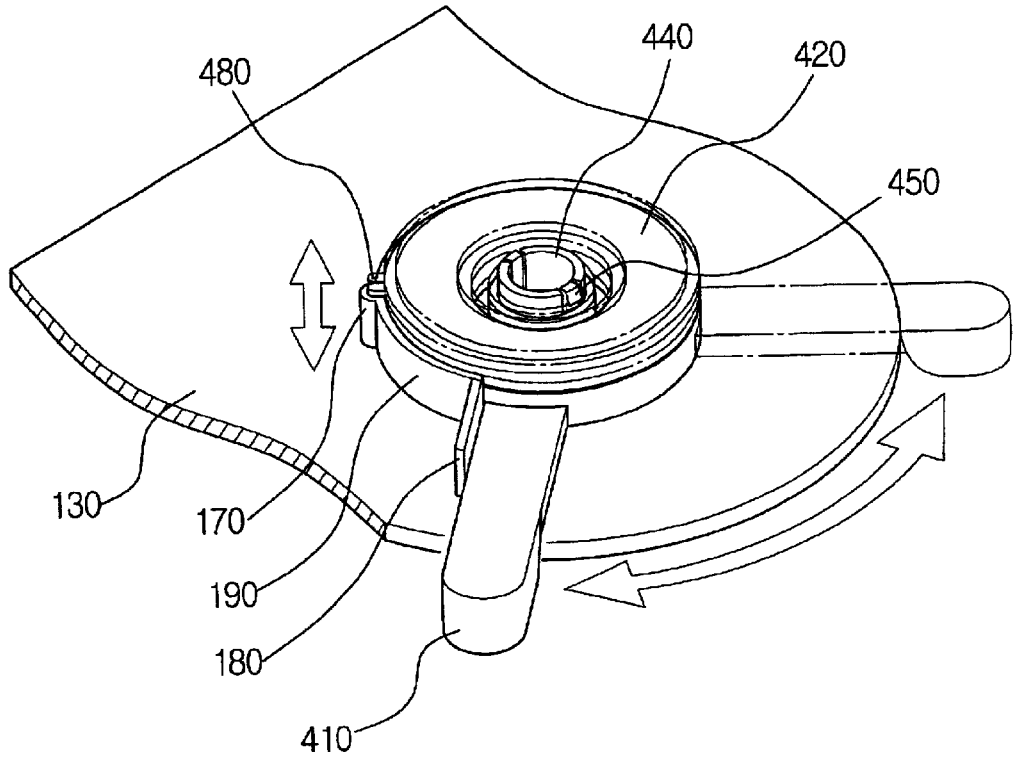
FIG. 6 is a cutaway, perspective view showing the locking unit of the upright-type vacuum cleaner according to the present invention.

As shown in FIGS. 5 and 6, the locking unit 400 is disposed at the front side of the cyclone-embracing portion 130, and as shown in FIG. 2, the dust-container 300 is removably mounted on a lower part of the cyclone unit 200 by the locking unit 400.

Figure 7:
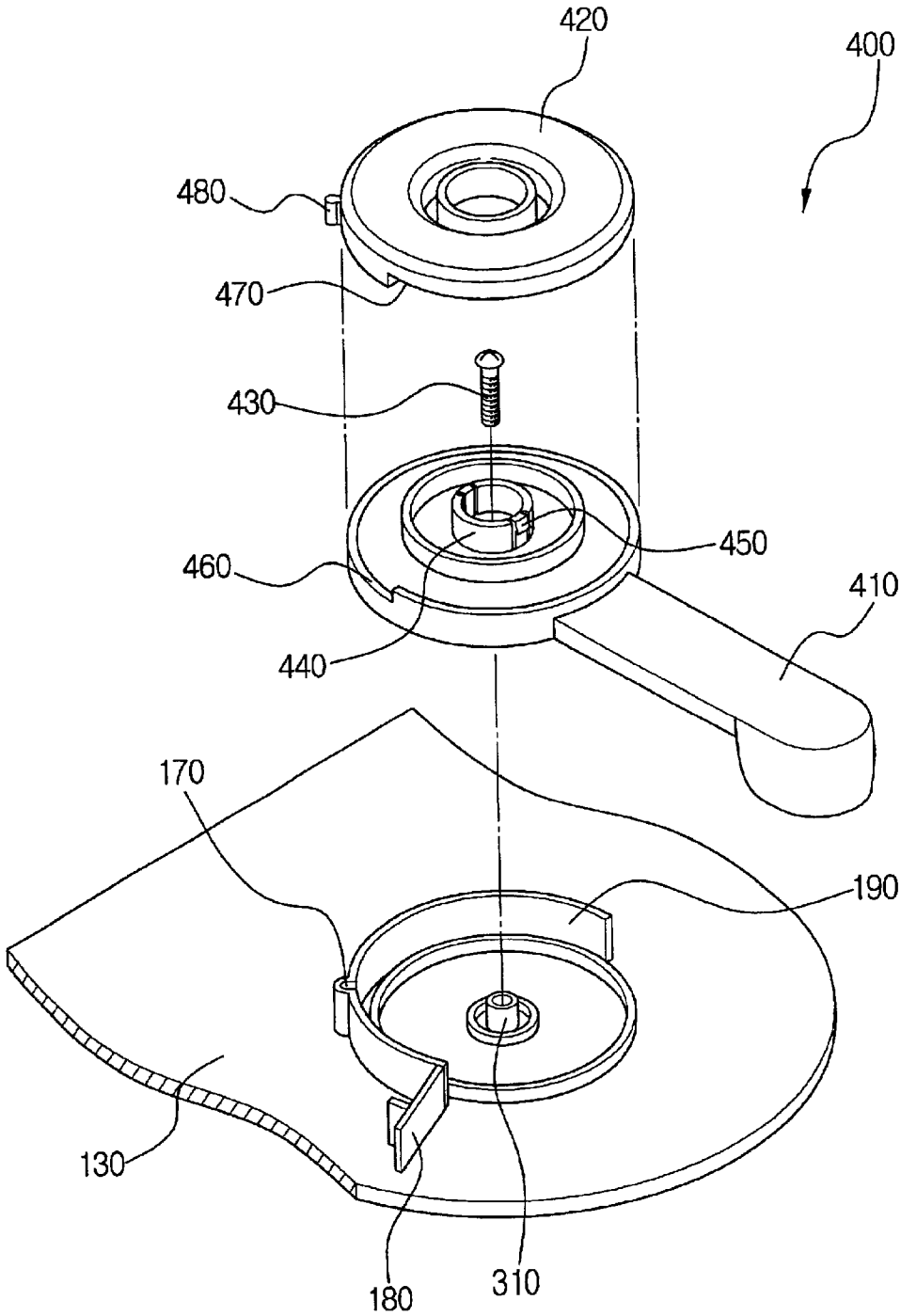
FIG. 7 is an exploded perspective view showing the locking unit of the upright-type vacuum cleaner according to the present invention.

The locking unit 400 includes an operating lever 410 and a locking disk 420. As shown in FIGS. 6 and 7, the hinge shaft 310 protrudes from the lower side of the cyclone-embracing portion 130, and an operating lever 410 is rotatably connected with the hinge axis 310 by the screw 430.

Another hinge shaft 440, which has a cavity formed therein and protruded upwardly, is formed at the rotating center of the operating lever 410, and the locking disk 420 is connected with the hinge shaft 440 for moving upwardly and downwardly. A hook 450 prevents the separation of the locking disk 420 from the operating lever 410.

A cam unit 460 is formed on the upper side of the operating lever 410, and another corresponding cam unit 470 is formed on the lower side of the locking disk 420. The locking disk 420 moves up and down along the hinge shaft 440 by a reciprocal action of the two cam units 460 and 470.

A protrusion 480 is formed on one side of the circumference of the locking disk 420, and a corresponding guide portion 170, is formed on the lower side of the cyclone-embracing portion 130 and engages protrusion 480 to prevent the rotation of the locking disk 420. Stopper 180 is provided to restrict the further rotation of operating lever 410.

Accordingly, as shown in FIG. 6, if the user rotates the operating lever 410 to the left, the dust container 300 is unlocked as the locking disk 420 moves down. If the user rotates the operating lever 410 to the right, the dust container 300 is locked again as the locking disk 420 moves up.

Meanwhile, in FIG. 7, the mounting support 190 supports the lower side of the dust-container 300 and prevents the lower side of the dust-container 300 from coming into contact with the locking unit 400 when the locking unit 400 is unlocked.

In an upright-type vacuum cleaner according to the present invention having the above construction, when the user wants to connect the cyclone unit 200 and the dust-container 300 with the cleaner body 100, the user first places the locking handle 230 in the vertical position, as shown in FIG. 4.

The user then inserts the suction passage 210, the discharging passage 220 and the locking handle of the cyclone unit 200 into the corresponding pair of tubes 140 and 150 and handle connection portion 160, and rotates the locking handle 230 90°, as shown in FIG. 4.

As described above, the cyclone unit 200 is thus firmly connected with the cyclone-embracing portion 130 of the cleaner body 100. Thus, the user does not need a separate tool or a part to mount the cyclone unit 200 on the cleaner body 100.

Then, as shown in FIG. 6, the user rotates the operating lever 410 to the left, and pushes the dust-container 300 into the cyclone-embracing portion 130 of the cleaner body 100, then rotates the operating lever 410 to the right.

Accordingly, the locking disk 420 moves upwardly by the reciprocal action of the pair of cam units 460 and 470, and the dust-container 300 is connected with the lower side of the cyclone unit 200.

On the other hand, when the user wants to empty the dust-container 300, the user rotates the operating lever 410 to the left, as shown in FIG. 6, to unlock the locking disk 420. In other words, the locking disk 420 moves downwardly along the hinge shaft 410 by the reciprocal action between the cam unit 460 of the operating lever 410 and the cam unit 470 of the locking disk 420, and by the weight of the dust-container 300.

Therefore, the user can pull out the dust-container 300 and empty it. Thus, the bottom of the dust-container 300 can be prevented from being damaged because the user can connect and separate the dust-container 300 with and from the cleaner body 100 without causing any frictional damage between the two.

In addition, when the user needs to separate the cyclone unit 200 from the cleaner body 100 for cleaning or repair, the user firstly removes the dust-container 300, and then places the locking handle 230 in the vertical position as shown in FIG. 4.

The user may then pull out the cyclone body, the cyclone unit 200 being separated from the cleaner body 100. Therefore, a separate tool or a part is not needed to separate the cyclone unit 200 from the cleaner body 100.

Consequently, according to the upright-type vacuum cleaner of the present invention described so far, there is an advantage that the cyclone unit 200 can be easily and promptly connected and separated with and from the cleaner body 100 without a use of a tool or a part.

Moreover, according to the upright-type vacuum cleaner of the present invention described so far, the user can connect and separate the dust-container 300 with and from the cleaner body 100 without causing any friction between the two, thus the bottom of the dust-container 300 can be prevented from being damaged.

The preferred embodiment of the present invention has been illustrated and described above. However, the present invention is not limited to the preferred embodiment described here, and someone skilled in the art can modify the present invention without distorting the point of the present invention claimed in the claim part.

What is claimed is:

1. An upright-type vacuum cleaner, comprising:

a cleaner body having a suction brush formed at a lower part, and a vacuum-generating device built therein;

a cyclone unit for separating dust from air drawn through a suction passage connected with the suction brush, and discharging clean air through a discharging passage connected with the vacuum-generating device; and a dust-container removably connected with a lower part of the cyclone unit, for collecting the dust separated by the cyclone unit, the cyclone unit having a locking handle, and a corresponding handle connection portion formed on the cleaner body for removably connecting with the locking handle.

2. The upright-type vacuum cleaner of claim 1, wherein the locking handle is a rotating knob.

3. The upright-type vacuum cleaner of claim 1, wherein the dust-container is secured by a locking unit that moves upwardly and downwardly.

4. The upright-type vacuum cleaner of claim 3, wherein the locking unit includes an operating lever rotatably installed on the cleaner body, and a locking disk that moves upwardly and downwardly in accordance with the rotation of the operating lever.

5. The upright-type vacuum cleaner of claim 4, wherein the operating lever and the locking disk each have a cam unit which engage to facilitate the upward and downward movement of the locking disk when the operating lever is rotated.

6. An upright-type vacuum cleaner, comprising;

a cleaner body having a suction brush formed at a lower part, and a vacuum-generating device built therein;

a cyclone unit for separating dust from air drawn through a suction passage connected with the suction brush, and discharging cleaned air through a discharging passage connected with the vacuum-generating device; and a dust-container removably connected with a lower part of the cyclone unit, for collecting the dust separated by the cyclone unit, the dust-container being secured by a locking unit that moves upwardly and downwardly.

7. The upright-type vacuum cleaner of claim 6, wherein the locking unit includes an operating lever rotatably installed at the cleaner body, and a locking disk that moves upwardly and downwardly in accordance with the rotation of the operating lever.

8. The upright-type vacuum cleaner of claim 7, wherein the operating lever and the locking disk each have a cam unit which work together to facilitate the upwardly and downwardly movement of the locking disk when the operating lever is rotated.

* * * * *

UNITED STATES PATENT AND TRADEMARK OFFICE

CERTIFICATE OF CORRECTION

PATENT NO. : 6,735,816 B2
DATED : May 18, 2004
INVENTOR(S) : Jang-Keun Oh et al.

It is certified that error appears in the above-identified patent and that said Letters Patent is hereby corrected as shown below:

Title page,
Item [30], Foreign Application Priority Data, delete "(JP)" and insert -- (KR) --.

Signed and Sealed this

Sixth Day of September, 2005

JON W. DUDAS
*Director of the United States Patent and Trademark Office*